United States Patent [19]

Neuhof

[11] 3,938,141

[45] Feb. 10, 1976

[54] SNAP-ON HOUSING ADAPTED FOR PANEL MOUNTING OF TRANSDUCER

[75] Inventor: Jacob Neuhof, Bridgeport, Conn.

[73] Assignee: General Signal Corporation, Rochester, N.Y.

[22] Filed: Jan. 6, 1975

[21] Appl. No.: 538,995

[52] U.S. Cl. ..... 340/384 R; 340/381

[51] Int. Cl.[2] ..... G08B 3/00

[58] Field of Search ..... 317/99; 340/381, 384 E, 340/384 R; 339/256 R, 258 R

[56] References Cited

UNITED STATES PATENTS

| | | | |
|---|---|---|---|
| 2,946,994 | 7/1960 | Dumke | 340/381 |
| 3,218,621 | 11/1965 | Foster | 340/384 R |
| 3,220,001 | 11/1965 | Hallerberg | 340/381 |
| 3,569,963 | 3/1971 | Mallory | 340/384 E |
| 3,803,593 | 4/1974 | Stampfli | 340/384 E |
| 3,818,486 | 6/1974 | Bailey | 340/381 |

*Primary Examiner*—Harold Pitts

*Attorney, Agent, or Firm*—Milton E. Kleinman; John Ohlandt

[57] ABSTRACT

A housing for a horn or like electro-acoustic element is provided, including a cover which will snap on the horn or the like by the application of slight pressure; however, removal of such cover from the horn requires significantly greater effort. Accordingly, a firm and long-lasting panel mounting is enabled.

9 Claims, 5 Drawing Figures

SNAP-ON HOUSING ADAPTED FOR PANEL MOUNTING OF TRANSDUCER

BACKGROUND, OBJECTS AND SUMMARY OF THE INVENTION

The present invention relates to a technique and to apparatus for encapsulating or housing an electrical component or assembly, and more particularly, to such a technique adapted to encapsulate a horn or like electro-acoustic device.

The present invention especially pertains to the cover member of such a housing, such cover member having the facility for snapping on the horn with the use of only slight pressure, thus being amenable for firm panel mounting of such horn or other electrical component.

In order to provide an appropriate background to the subject matter of the present invention, reference may be made to U.S. Pat. No. 3,569,963 in which a complete alarm system is described and in which an alarm unit is shown as being encapsulated for mounting thereof. Particular reference may be made to FIG. 5 of the aforesaid patent in which there is shown an arrangement involving potting of a printed circuit board within a plastic housing and including a mounting ring at the front end of the housing for mounting the housing to a panel or the like.

It is a foundamental object of the present invention to improve upon the mounting and housing techniques and apparatus heretofore known for use in connection with electrical components.

Another object is to avoid the necessity for the use of screws or bolts or other complicated means for insuring the firm retention of electrical components, thereby to simplify to an extreme point the entire manufacturing operation.

A further object is to simplify the manufacturing operation by affording a press fit for the housing of electrical components which is superior to those known previously.

A further object is to provide extreme versatility in manufacturing such that a unit destined for panel mounting can be produced and this same unit can be adapted as a finished article for other uses and not necessarily only for mounting to a panel or the like.

The above and other objects are fulfilled and implemented by a major feature of the present invention which provides a cover or front end bracket as part of a housing adapted to house or encapsulate an electrical component; and further provides a back-end bracket or housing which, in similar fashion, snaps onto the horn or other electrical component. The cover and the back-end housing are complementarily formed in that they are provided with interdigitating or interfitting projections at their respective rims so that a complete encapsulation of the horn assembly can be effectuated when desired.

It is a more specific feature of the present invention that each of the fingers or projections which are spaced around the rim or periphery of each of the cover and back-end bracket is provided with a groove or channel for receiving and firmly gripping a flange-like portion at the periphery of the horn assembly. Moreover, each of the grooves, on both the cover and back-end housing, is preceded by a pear-shaped projection extending inwardly and serving to limit relative movement between the horn assembly and the two parts of the housing. However, with exertion of a reasonable amount of pressure the horn assembly will be received into the spaced grooves and will be retained therein.

A further feature of the invention resides in the provision of an integral ring formed at the inner periphery of the cover such that, when the horn assembly is moved into the spaced grooves, the front-plate or cover plate of such horn unit will abut said ring.

Another feature of the present invention resides in the provision of a unique combination of an audible and visible signal in an alarm unit, the housing for which has been already described. In accordance with such feature, an appropriate tone or audio signal of the order of 2500 Hz is supplied to the horn or transducer element of the alarm unit and this tone is interrupted at a predetermined rate by a regulated interrupter or pulsing circuit. It is specifically provided that the interrupted tone is supplied coincidently to both the horn and a suitable visual indicator, such as a light-emitting diode. However, it could be so arranged that the horn and the light-emitting diode would receive alternate half-cycles of the power supply. The light-emitting diode is arranged to project outwardly from the front of the unit at the center of a perforated plate or grill formed as part of the cover so as to permit emission of the tone signal.

The above described feature enables the alerting of supervisory personnel by visual means as well as by the tone means. The reason this is important is that in many installations a variety of conflicting tones and alarms are being emitted into a given ambient and it is extremely useful to be able to pinpoint the particular tone source; that is, to have a means further identifying which audible alarm is being given at a particular time.

Further and other objects, advantages and features of the invention will be apparent from the following description of a preferred form of the invention as seen in the accompanying drawings.

PREFERRED EMBODIMENT OF THE INVENTION

Figure 1:
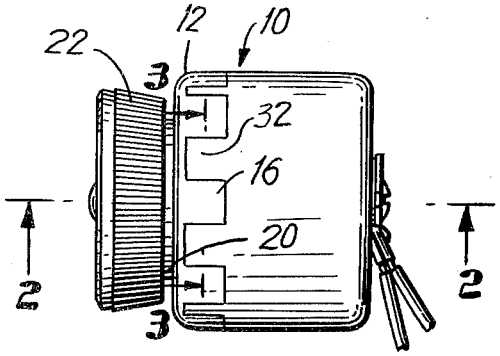
FIG. 1 is an elevational view of a completely housed electro-acoustic unit of the present invention.
Figure 2:
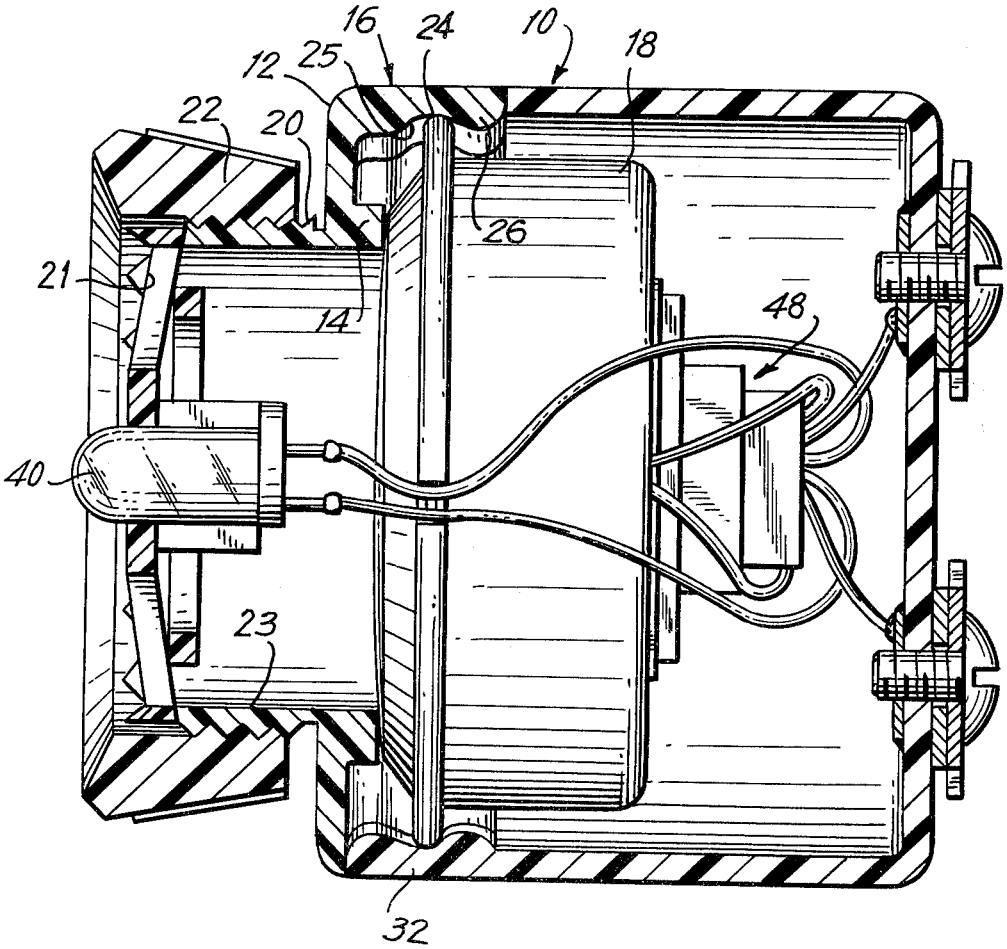
FIG. 2 is a sectional view, taken on the line 2—2 of FIG. 1, illustrating the various components, particularly the visual indicator and the horn or electro-acoustic transducer.

Referring now to the drawings, and in particular for the moment to FIGS. 1 and 2, there is shown in complete alarm unit embodying the features or aspects of the present invention in a preferred form. There will be seen a complete alarm unit 10, comprising a cover 12, preferably made of styrene, which in this embodiment is annular in form and is provided at its inner periphery with an upstanding or axially extending ring 14. Also extending axially in the same direction as ring 14 but at the outer periphery of the cover is a series of spaced fingers or tabs 16. These fingers 16 are adapted to secure and to hold an electro-acoustic transducer or horn assembly 18.

Extending from the front side of the cover is a threaded boss or neck portion 20 which is adapted to be utilized in the event that the transducer housing is to be mounted on a panel or the like. Thus, the threaded neck portion would be extended through a suitable opening in such panel. A threaded mounting ring 22 is provided for the purpose of securing the housing to such panel. It will be further noted that a series of perforations 21 are provided at the end of the neck portion 20 so that sound to be emitted by the horn assembly 18 will be permitted to pass through. The interior cavity 23 defined by the neck portion 20, being located at the front of horn assembly 18, acts to increase the sound level output to the ambient.

Figure 3:
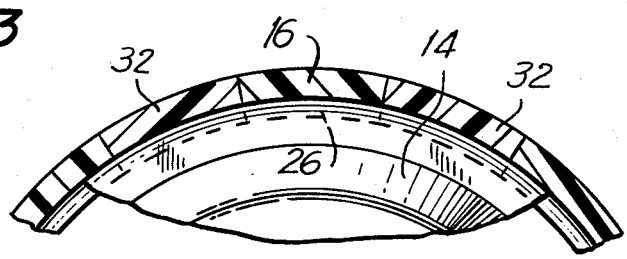
FIG. 3 is a fragmentary view taken on the line 3—3 of FIG. 1 through the fingers or tabs on the cover and back-end housing member.
Figure 4:
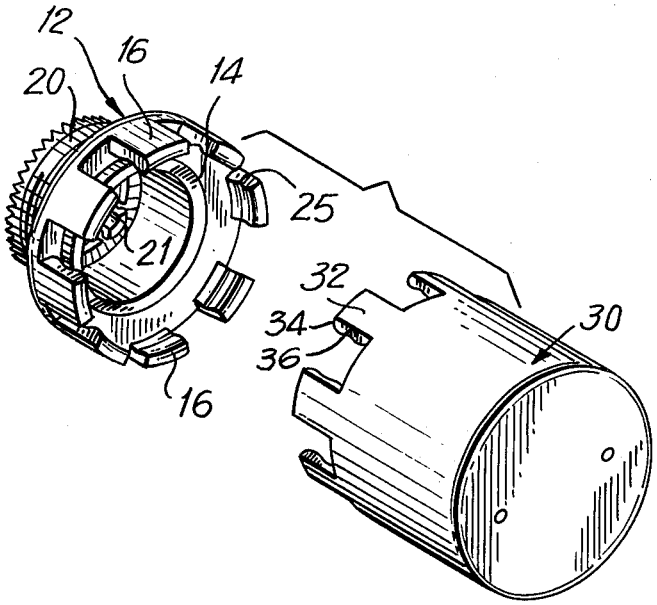
FIG. 4 is an exploded perspective view of the transducer housing, particularly illustrating the interdigitating or interfitting tabs on each of the cover and back-end housing, and further illustrating the abutting ring within the cover.

The detailed construction at the inner surface of each of the fingers 16 on cover 12 may be appreciated by reference to FIGS. 2, 3 and 4, such construction permitting the bringing together of the horn assembly 18 and the cover 12; that is to say, the cover 12 may be snapped onto the horn assembly 18 by application of slight pressure. Thus, such pressure applied to the pear-shaped leading section 24 of each of the fingers 16 will, because of the resilient nature of such fingers, cause them to spring outwardly until the pressure applied is sufficiently great that the horn assembly 18 is forced into the groove-like portions 25.

The radii of curvature for the initial convex portions 26 vary along the interior surface of the tabs or fingers such that only slight pressure is required to snap the cover 12 onto the horn assembly; however, a great deal of pressure is required to release the horn assembly. This is for the reason that the radius of curvature at the leading part or convex portion 26 is, for example, one-thirtieth of an inch whereas, at the reverse curve part, i.e., at the curves defining the grooves 25, it is one-sixteenth of an inch. Accordingly, the horn assembly 18 will be very firmly secured and retained in the grooves 25 of the fingers 16.

It will be appreciated that the construction thus far described in accordance with the present invention enables ready panel mounting of an electrical component such as the electro-acoustic unit 18 heretofore noted. Thus, utilizing solely the cover 12 and its associated mounting ring 22, the electro-acoustic unit 18 can be securely mounted to a panel or the like. However, if it is desired to completely enclose or encapsulate the electro-acoustic unit 18, the back-end bracket or housing 30, which is also preferably made of styrene, can be interfitted with the annular cover 12. It will be seen that, particularly in FIG. 3, this back-end bracket 30 has a corresponding or mating series of fingers or tabs 32. The detailed construction of such fingers 32 is identical to the fingers or tabs 16 for the cover 12; that is to say, pear-shaped leading sections 34 are provided at the underside or interior surface of the free ends of the fingers 32, these including grooves 36 whereby the back-end bracket 30 will snap onto the electro-acoustic unit 18 in identical fashion as was the case for the cover.

Figure 5:
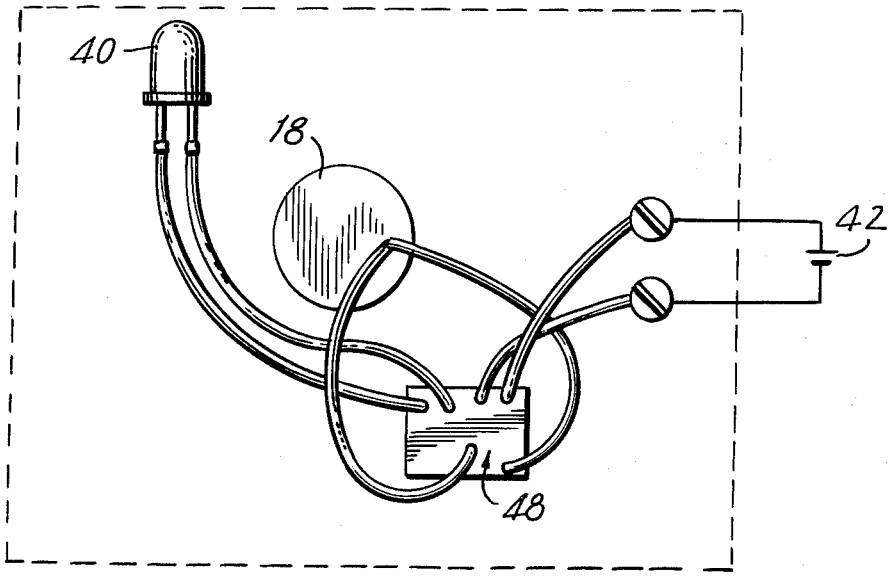
FIG. 5 is a wiring diagram illustrating the interconnection of the circuit components, especially the visual indicator and for the electro-acoustic transducer.

The feature of the invention which provides for a combination of audible and visible signals in an alarm unit can be especially appreciated by referring to FIGS. 2 and 5. In the latter figure, a wiring diagram is illustrated showing the interconnection of the components of the alarm unit for the combination purposes.

It will be seen in FIG. 2 that a light source 40, preferably a light-emitting diode, projects through a suitable aperture in the cover 12. The light source 40 is connected to the output side of a printed circuit board 48, as seen in FIG. 5. The horn assembly 18 is also connected to the same output side of printed circuit board 48. A suitable source of power, shown as a battery 42, is selectively connected, responsive to an alarm condition, to the input side of board 48. A circuit for producing an oscillatory output current is formed on board 48. Such a circuit can be, for example, identical to that disclosed in copending application (Docket ED–166), the subject matter of which is incorporated by reference herein.

The oscillatory output current or tone, which is supplied to both the light source 40 and horn assembly 18, is interrupted at a predetermined rate by a well-regulated pulsing circuit, also formed on printed circuit board 48. Such a pulsing circuit, per se, is well known in the art and its operation will be understood by those skilled in the art. Preferably, the interruption rate is ninety pulses per minute. The interrupted tone produced is especially advantageous in surroundings in which a continuous tone would be masked by a high ambient noise level. As indicated previously, the combination of an audible and a visual signal operating coincidentally is extremely useful in these same surroundings inasmuch as it enables pin-pointing the particular source or nature of an emergency or alarm condition.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A housing for an electrical component, said component having a flange-like portion at its periphery, comprising:

a cover having a series of resilient axially extending, spaced fingers or tabs at the periphery thereof;

each of said fingers having a convex leading portion and an abutting groove at its inner surface, the grooves together receiving the flange-like portion at the periphery of the electrical component;

a back-end bracket having a like series of resilient axially extending, spaced fingers, as defined above, which likewise receive the flange-like portion at the periphery of said component and which fit between the fingers on said cover such that a complete housing is provided and said component is firmly retained inside said housing.

2. A housing as defined in claim 1, in which the radius of curvature at the convex leading portion has a predetermined value, whereas the radius of curvature at the groove portion has a much lesser value whereby the periphery of the electrical component can with slight pressure be pushed against the resilient fingers but the component will be firmly retained in the aforesaid grooves.

3. A housing as defined in claim 1, in which said cover and said back-end bracket are composed of styrene and both are round in shape.

4. An alarm unit including a housing as defined in claim 3 and further including an oscillator for generating an alarm tone, and an electro-acoustic transducer, said transducer being contained in an assembly which is round in shape and is adapted to be held within the grooves in said housing.

5. An alarm unit as defined in claim 4, in which the cover of the housing includes a threaded boss extending axially forwardly of said cover, the end of said boss being perforated to permit the emission of sound from said electro-acoustic device.

6. An electrical component housing adapted to be mounted on a panel or the like, said component having a flange-like portion at its periphery, comprising:

a cover having a series of resilient, axially extending, spaced fingers or tabs at the rim thereof;

said fingers having arcuate sections located at the free ends of said fingers, said sections including respective convex leading portions and grooves on their inner surfaces for receiving said flange-like portion at the periphery of said component, thereby firmly retaining the electrical component;

a threaded boss extending axially at the front of said cover.

7. A housing as defined in claim 6, further comprising an electro-acoustic transducer, and in which housing perforations are provided at the end of said boss to permit the emission of sound from said electro-acoustic transducer.

8. A housing as defined in claim 6, including a cavity or chamber at the interior of said boss for increasing the sound output from said electro-acoustic transducer.

9. A housing as defined in claim 6, including a narrow flange or ring abutting said component at the front thereof when said component is received into said grooves.

* * * * *